US006588414B2

(12) United States Patent
McMillan, III

(10) Patent No.: US 6,588,414 B2
(45) Date of Patent: Jul. 8, 2003

(54) ARCHERY BOW VIBRATION DAMPER

(76) Inventor: Thomas E. McMillan, III, 200 Cottage Pl., Charlotte, NC (US) 28207

( * ) Notice: Subject to any disclaimer, the term of this patent is extended or adjusted under 35 U.S.C. 154(b) by 0 days.

(21) Appl. No.: 10/119,457

(22) Filed: Apr. 9, 2002

(65) Prior Publication Data

US 2002/0162547 A1 Nov. 7, 2002

Related U.S. Application Data

(60) Provisional application No. 60/288,139, filed on May 2, 2001.

(51) Int. Cl.[7] ..... F41B 5/20
(52) U.S. Cl. ..... 124/89; 124/88
(58) Field of Search ..... 124/23.1, 86, 88, 124/89

(56) References Cited

U.S. PATENT DOCUMENTS

| | | | | |
|---|---|---|---|---|
| 3,412,725 | A | | 11/1968 | Hoyt, Jr. |
| 3,524,441 | A | | 8/1970 | Jeffery |
| 3,628,520 | A | | 12/1971 | Izuta |
| 3,683,883 | A | | 8/1972 | Izuta |
| 4,135,486 | A | | 1/1979 | Enomoto |
| 4,570,608 | A | | 2/1986 | Masterfield |
| 4,615,327 | A | | 10/1986 | Saunders |
| 4,893,606 | A | | 1/1990 | Sisko |
| 4,936,283 | A | | 6/1990 | Izuta |
| 5,090,396 | A | | 2/1992 | Bickel et al. |
| 5,339,793 | A | | 8/1994 | Findley |
| 5,433,792 | A | * | 7/1995 | Darlington |
| 5,595,168 | A | | 1/1997 | Martin |
| 5,975,070 | A | | 11/1999 | Sands |
| 5,996,570 | A | | 12/1999 | Legate |
| 6,257,220 | B1 | | 7/2001 | McPherson et al. |
| 6,382,201 | B1 | * | 5/2002 | McPherson et al. ..... 124/89 |

* cited by examiner

*Primary Examiner*—John A. Ricci
(74) *Attorney, Agent, or Firm*—John V. Stewart

(57) ABSTRACT

An archery bow vibration damper that is mounted in an open chamber passing through a bow riser from front to back. A tube of soft but supportive material, such as rubber is pushed into the chamber. A tightly fitting shaft, preferably of metal with internal threads at each end, is pushed into the tube. The shaft provides damped mass and shock mounting for stabilizers and other accessories on the front and/or back of the bow riser. Installation of the damper requires pushing the soft tube through the chamber from the front of the riser, then pushing the shaft through the tube from the front or back. The shaft preferably has a cross section outline that varies in size or shape along the length of the shaft to resist slippage of the shaft in the tube.

10 Claims, 4 Drawing Sheets

ARCHERY BOW VIBRATION DAMPER

CROSS-REFERENCE TO RELATED APPLICATIONS

This application claims the benefit of U.S. Provisional application No. 60/288,139, filed May 2, 2001.

BACKGROUND OF THE INVENTION

1. Field of the Invention

This invention relates to archery bow vibration dampers, bow stabilizers, and bow accessory mounts.

2. Description of Prior Art

The accuracy of a hunting or target bow depends largely on elimination of extraneous motions of the bow. Even minute motions or vibrations have an amplified affect on the arrow trajectory. For this reason, archery bows have been provided with a variety of vibration damping devices. For example, a soft compound such as rubber may be attached to the bow riser to absorb vibration. Various materials, configurations, and placements of soft attachments are shown in the prior art. Another device seen in the prior art is a capsule of gel or liquid, including mercury, in the bow riser for the same purpose. However, these mechanisms are not fully effective.

Precision hunting bows are often provided with a stabilizer, which is a mass extending forward from the bow riser on a rod. This balances the bow longitudinally about the grip so the bow does not rotate to an over-shoot position by gravity upon release of the arrow. It also adds inertia that reduces bow vibrations.

It is desirable to shock-mount the stabilizer on the bow riser, for effective vibration damping. U.S. Pat. No. 4,135,486 of Enomoto shows stabilizers mounted to a bow by dampers that screw into the front of the bow riser. The present invention is an improved shock mount for bow stabilizers that is more effective and more flexible in its usage configurations.

SUMMARY OF THE INVENTION

The main objective of the present invention is provision of an archery bow vibration damper that is highly effective and is flexible in configuration. A further objective is a bow vibration damper that works with or without a bow stabilizer, and can act as a shock mount for standard bow accessories, including stabilizers, on the front and/or back sides of the bow riser. A further objective is quick, tool-less assembly and installation of the damper in the riser, and quick tool-less attachment of accessories on the damper.

These objectives are achieved in an archery bow vibration damper that is mounted in an open chamber passing through a bow riser from front to back. A tube of soft but supportive material, such as rubber is pushed into the chamber. A tightly fitting shaft, preferably of metal with internal threads at each end, is pushed into the tube. The shaft provides damped mass and shock mounting for stabilizers and other accessories on the front and/or back of the bow riser. Installation of the damper requires pushing the soft tube through the chamber from the front of the riser, then pushing the shaft through the tube from the front or back. The shaft preferably has a cross section outline that varies in size or shape along the length of the shaft to resist slippage of the shaft in the tube.

REFERENCE NUMERALS

Figure 1:
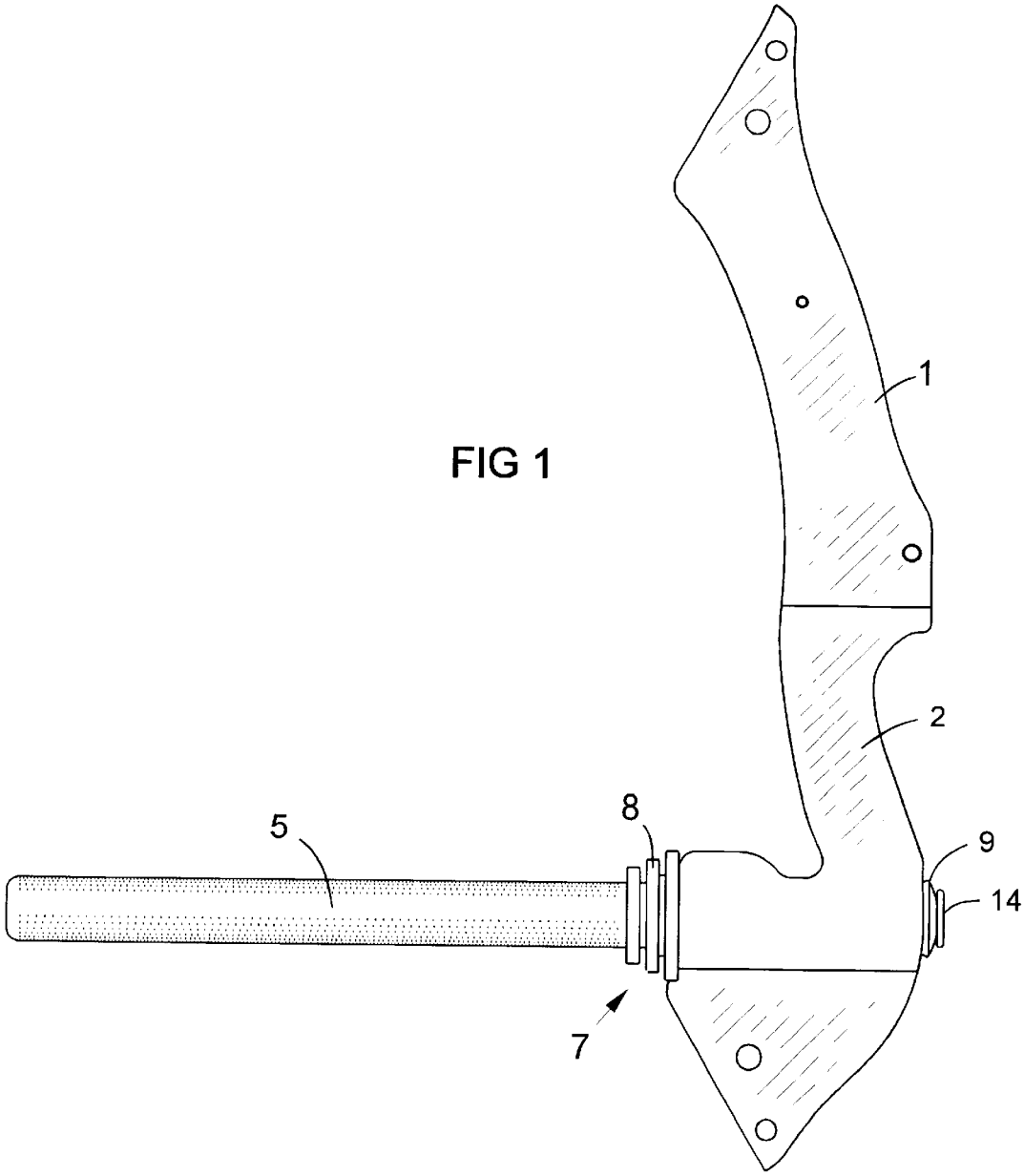
FIG. 1 Left side view of bow handle with damper and forward-extending stabilizer.
Figure 2:
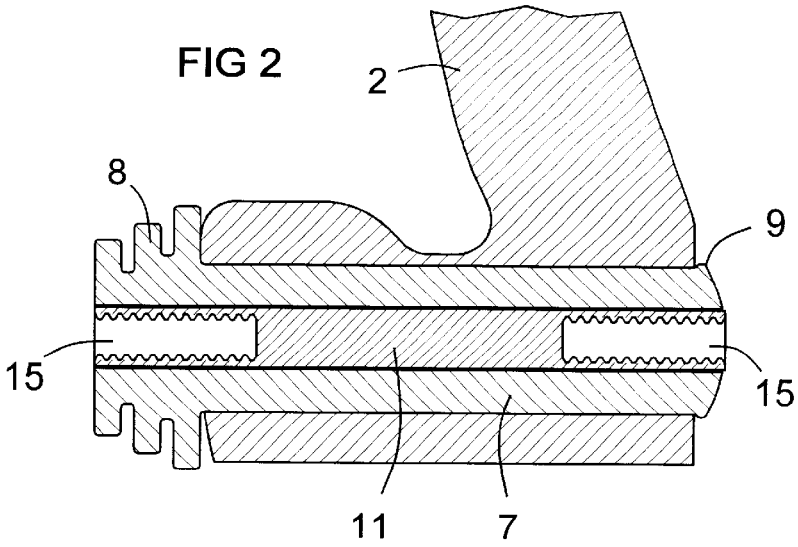
FIG. 2 Enlarged left side sectional view of damper assembled in bow handle.
Figure 3:
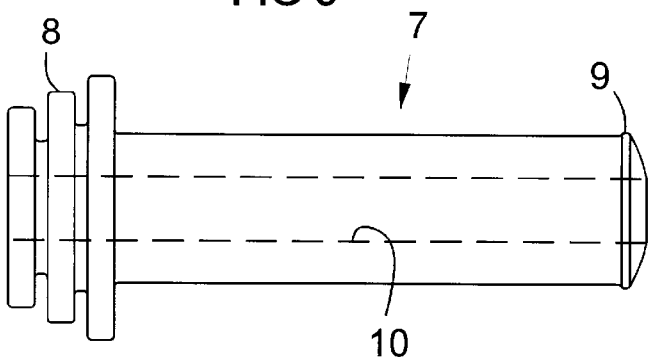
FIG. 3 Left side view of tube.
Figure 4:
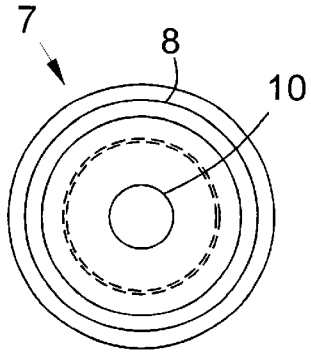
FIG. 4 Front view of tube.

1. Bow handle or riser
2. Bow grip
3. Chamber in bow handle for damper
5. Bow stabilizer or balancer
6. Stabilizer attachment screw
7. Soft support tube
8. Enlarged front of damper
9. Annular lip on back of damper
10. Central hole through tube for shaft
11. Shaft
12. Cylindrical portion of shaft
13. Square cross-section portion of shaft
14. Shaft end bolt
15. Shaft internal threads
16. Optional enlarged central portion of shaft

TERMINOLOGY

Front, Back—Orientation terms are with respect to the direction of an arrow mounted in the bow for shooting.

Soft support material—a material that is elastic but supportive, such as rubber, foam rubber, cork, elastomeric plastic, and the like.

DETAILED DESCRIPTION

The present invention is a damper for an archery bow. It comprises a tube 7 made of a soft support material such as rubber, foam rubber, expanded plastic, cork, elastomeric plastic, or the like, mounted in a chamber 3 in the bow handle or riser 1. A preferred form of the tube 7 is shown in the drawings as a cylindrical tube of damping material with an enlarged front portion 8. The enlarged front portion may be convoluted as shown or not convoluted. Other forms are possible.

Figure 9:
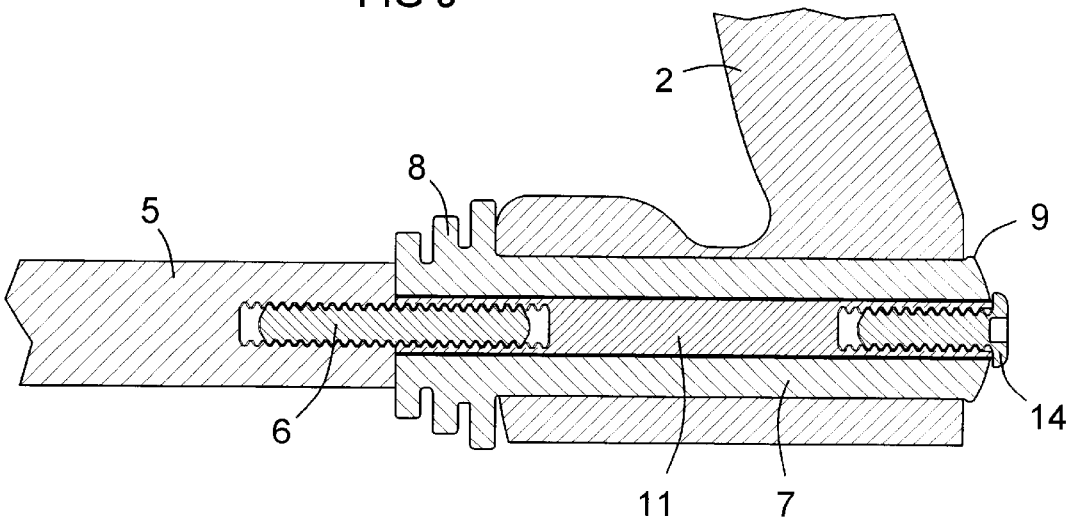
FIG. 9 Enlarged left side sectional view of damper assembled in bow handle with an attached stabilizer.

A shaft 11 passes through the tube. Both ends of this shaft preferably have internal threads to receive accessories, including a stabilizer on the front and/or back of the riser as shown in FIG. 9. Optionally a bolt 14 can be screwed into the back end of the shaft to block forward slippage of the shaft in the damper. However, this is unnecessary if the shaft fits tightly in the tube as later described.

The tube 7 is preferably a close fit in the chamber 3. It preferably has an annular lip 9 on the back end that is slightly larger in diameter than the chamber. The tube 7 without the shaft 11 is pushed into the chamber 3 from the front. If a lip 9 is provided, it is radially compressed enough to pass through the chamber. The shaft 11 is then pushed through the tube from either the front or back. The shaft should have an interference fit in the tube. This compresses the tube radially against the interior of the chamber and against the exterior of the shaft, thus holding the tube and shaft in the chamber by friction. It has been found that additional fastening in the assembly is not needed, making assembly quick.

Figure 5:
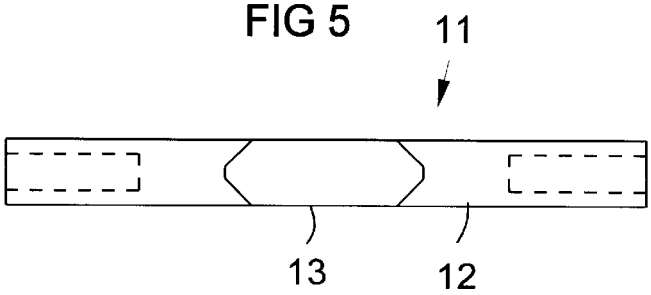
FIG. 5 Left side view of shaft.
Figure 6:
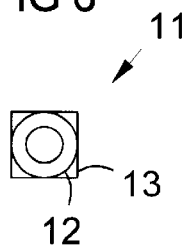
FIG. 6 Front view of shaft.
Figure 7:
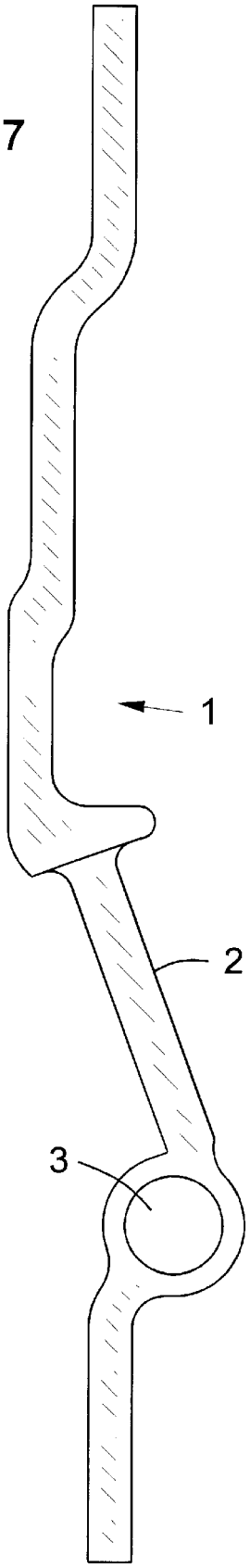
FIG. 7 Front view of bow handle or riser.
Figure 8:
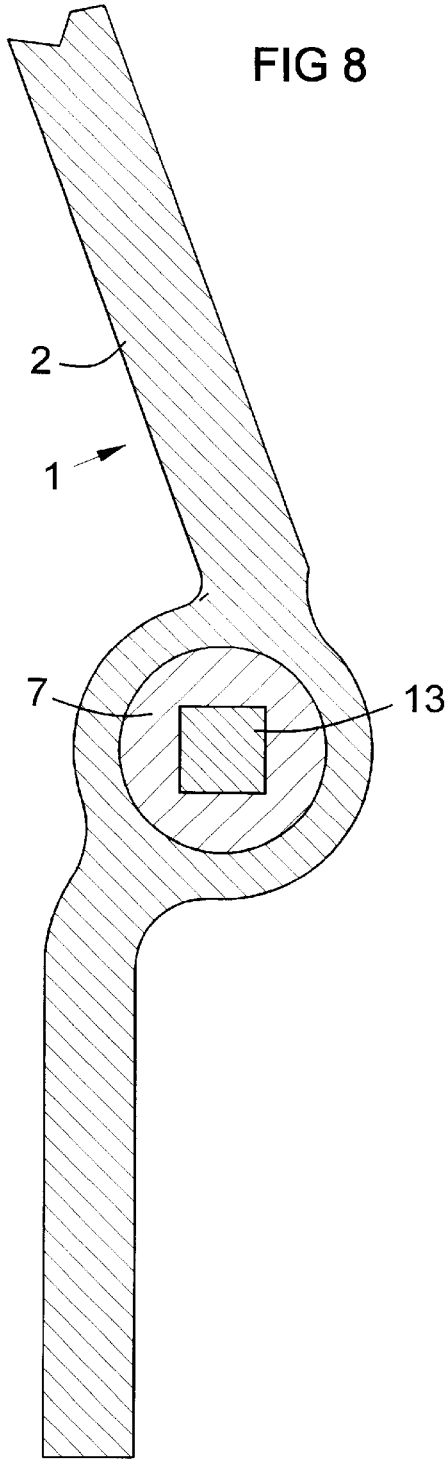
FIG. 8 Enlarged front sectional view of damper assembled in bow handle.
Figure 10:
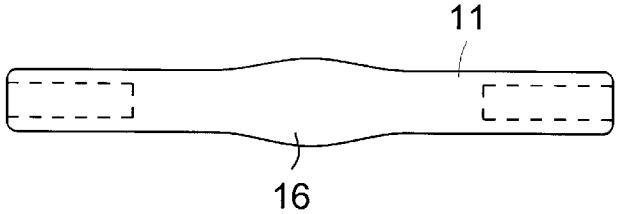
FIG. 10 Side view of an alternate shaft form with an enlarged central portion.
Figure 11:
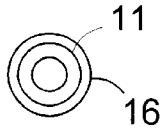
FIG. 11 End view of FIG. 10.

The shaft 11 preferably has a central portion 13 with a non-circular cross section, such as square as shown in FIGS. 5 and 6. This prevents the shaft from rotating or slipping longitudinally in the tube. It allows accessories and stabilizers to be screwed into the internal threads of the shaft without tools. Other differences in cross section can be used. For example, part of the shaft can have a rectangular cross section, and another part of the shaft can have the same cross section rotated 90 degrees (not shown). Another option is a shaft with an enlarged central portion or bulb as shown in FIGS. 10–11. The shaft and bulb can have circular or non-circular cross sections. The bulb increases pressure and friction on the shaft and tube, and retains the shaft against longitudinal slippage. For assembly, the shaft can be lubricated and pushed into the tube, either manually or with a press. Optionally the lubricant can be glue for permanent attachment of the shaft to the tube. The shaft is preferably of metal for maximum damping mass. However, another shaft material may be used to minimize bow weight.

In operation, the shaft alone and/or an attached stabilizer provides a damped mass that reduces bow vibrations more effectively than a simple container or patch of damping material. This increases shot accuracy and reduces user fatigue.

This archery bow vibration damper is effective, convenient, and flexible in use. It provides a centered damped mass, and optionally provides shock mounting for accessories on the front and/or back of the bow riser. No tools are required for attachment of accessories or stabilizers. Optionally, a damper according to the present invention can be provided both below and above the grip on the bow riser.

Although the present invention has been described herein with respect to preferred embodiments, it will be understood that the foregoing description is intended to be illustrative, not restrictive. Modifications of the present invention will occur to those skilled in the art, so the claims should determine its scope.

What is claimed is:

1. An archery bow vibration damper, comprising:

an archery bow riser having a front side and a back side;

an open chamber passing from the front side to the back side of the bow riser, open on both the front and back sides of the bow riser;

a flexible tube of soft support material mounted in the chamber, having front and back ends and a central hole passing through the tube from front to back;

a shaft having front and back ends, the shaft tightly mounted in the hole of the tube and extending from the front to back ends of the tube.

2. The archery bow vibration damper of claim 1 wherein the shaft has internal threads at both the front and back ends, whereby bow accessories including stabilizers can be mounted at either or both ends of the shaft as desired, and such accessories will both damp bow vibrations and be isolated from them.

3. The archery bow vibration damper of claim 1, wherein the shaft has a cross section outline that varies in shape along the length of the shaft to resist rotation and slippage of the shaft in the tube.

4. The archery bow vibration damper of claim 1, wherein the shaft has a cross section outline that varies in area along the length of the shaft to resist rotation and slippage of the shaft in the tube.

5. The archery bow vibration damper of claim 1, further including an archery bow stabilizer having a back end attached to the front end of the shaft.

6. An archery bow vibration damper, comprising:

an archery bow riser having a front side and a back side;

an open chamber passing from the front side to the back side of the bow riser, open on both the front and back sides of the bow riser;

a flexible tube of soft support material mounted in the chamber, having front and back ends and a central hole passing through the tube from front to back; and a shaft tightly mounted in the hole of the tube and extending from the front to back ends of the tube, the shaft having front and back ends, with internal threads at both ends of the shaft;

whereby bow accessories including stabilizers can be mounted at either or both ends of the shaft as desired, and such accessories will both damp bow vibrations and be isolated from them.

7. The archery bow vibration damper of claim 6, wherein the shaft has a cross section outline that varies in shape along the length of the shaft to resist rotation and slippage of the shaft in the tube.

8. The archery bow vibration damper of claim 6, wherein the shaft has a cross section outline that varies in area along the length of the shaft to resist rotation and slippage of the shaft in the tube.

9. The archery bow vibration damper of claim 6, further including an archery bow stabilizer having a back end attached to the front end of the shaft.

10. An archery bow vibration damper, comprising:

an archery bow riser having a front side and a back side;

an open chamber passing from the front side to the back side of the bow riser, open on both the front and back sides of the bow riser;

a flexible tube of soft support material mounted in the chamber, having front and back ends and a central hole passing through the tube from front to back; and a shaft having front and back ends, tightly mounted in the hole of the tube and extending between the front and back ends of the tube, the shaft having a cross section outline that varies along the length of the shaft to resist rotation and slippage of the shaft in the tube, the shaft having internal threads at both the front and back ends of the shaft;

whereby bow accessories including stabilizers can be mounted at either or both ends of the shaft as desired, and such accessories will both damp bow vibrations and be isolated from them.

* * * * *